US009418632B2

(12) United States Patent
Snyder

(10) Patent No.: US 9,418,632 B2
(45) Date of Patent: Aug. 16, 2016

(54) SPEED PICK, ASSOCIATED SYSTEMS AND METHODS

(71) Applicant: Dalton Thomas Snyder, Hartley, IA (US)

(72) Inventor: Dalton Thomas Snyder, Hartley, IA (US)

( * ) Notice: Subject to any disclaimer, the term of this patent is extended or adjusted under 35 U.S.C. 154(b) by 0 days.

(21) Appl. No.: 14/696,147

(22) Filed: Apr. 24, 2015

(65) Prior Publication Data

US 2015/0310839 A1 Oct. 29, 2015

Related U.S. Application Data

(60) Provisional application No. 61/983,763, filed on Apr. 24, 2014.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 1,117,056 A * 11/1914 Knackstedt ..... G10D 3/163 84/322
2,170,179 A * 8/1939 Wolcott ..... G10D 3/163 84/322
2,459,274 A * 1/1949 Galetzky ..... G10D 3/163 84/320
2,484,820 A * 10/1949 Galetzky ..... G10D 3/163 84/322
3,319,505 A * 5/1967 Galetzky ..... G10D 3/163 84/322
4,711,150 A * 12/1987 Hyduck ..... G10D 3/163 84/322
4,993,302 A * 2/1991 Jonathan ..... G10D 3/163 84/322
5,419,228 A * 5/1995 Garrett ..... G10D 3/163 84/322
5,610,349 A * 3/1997 Fogarty ..... G10D 3/163 84/322
5,648,622 A * 7/1997 Storey ..... G10D 3/163 84/322
5,894,097 A * 4/1999 Barry ..... G10D 3/163 84/322
6,040,512 A * 3/2000 Polley ..... G10D 3/163 84/320
6,130,374 A * 10/2000 Polidori ..... G10D 3/163 84/320
6,245,977 B1 * 6/2001 Byrns ..... G10D 3/163 84/320
6,417,431 B1 * 7/2002 Wilkinson ..... G10D 3/163 84/320
7,060,882 B2 * 6/2006 Greenwald ..... G10D 3/163 84/320
7,067,729 B2 * 6/2006 Leong ..... G10D 3/163 84/320
7,145,066 B1 * 12/2006 Moreland ..... G10D 3/163 84/320
7,238,869 B1 * 7/2007 Kleckzka ..... G10D 3/163 84/320
7,371,950 B2 * 5/2008 Benyahia ..... G10D 3/163 84/320
7,462,768 B2 * 12/2008 Newmaster ..... G10D 3/163 84/320
7,683,245 B2 * 3/2010 Judd ..... G10D 3/163 84/320
8,035,017 B1 * 10/2011 Morris ..... G10D 3/163 84/320
8,076,560 B2 * 12/2011 McKee ..... G10D 3/163 84/320
D654,532 S * 2/2012 Morales ..... D17/20
8,330,029 B2 * 12/2012 Dunlop ..... B25G 1/102 36/59 C
8,648,239 B2 * 2/2014 Tommasi ..... G10D 3/163 84/322
8,962,959 B1 * 2/2015 Mier ..... G10D 3/163 84/322
9,202,446 B2 * 12/2015 Gauthier ..... G10D 3/163
2005/0211053 A1 * 9/2005 Ball ..... G10D 3/163 84/322
2013/0152763 A1 * 6/2013 Aletto ..... G10D 3/163 84/329
2015/0310839 A1 * 10/2015 Snyder ..... G10D 3/163 84/322

* cited by examiner

*Primary Examiner* — Robert W Horn

(57) ABSTRACT

The disclosure is a plectrum used for playing a stringed instrument comprising a generally acute isosceles triangle body and further comprising at least one pad, groove, inlet or opening. These picks are designed to provide the user with improved control, dexterity and further provide certain acoustic advantages.

8 Claims, 7 Drawing Sheets

SPEED PICK, ASSOCIATED SYSTEMS AND METHODS

CROSS-REFERENCE TO RELATED APPLICATION(S)

This application claims priority to U.S. Provisional Application No. 61/983,793 filed Apr. 24, 2014 and entitled "Speed Pick," which is incorporated herein by reference in its entirety under 35 U.S.C. §119(e).

FIELD OF THE INVENTION

The instant application encompasses various embodiments relating to improved apparatus, systems and methods in music. More specifically, this disclosure is directed toward an improved plectrum for playing a stringed musical instrument, and the associated systems and methods.

BACKGROUND OF THE INVENTION

The disclosure relates to various embodiments of an apparatus, systems and method for use in the playing of a stringed musical instrument by way of a plectrum, or "pick."

The use of plectra on stringed instruments dates back at least a thousand years. Over that period, however, relatively little improvement has guitar picks have been developed over the years.

Guitar players who want to produce different sounds from a single instrument often keep an assortment of picks to choose from during a music session.

The inventions heretofore known suffer from a number of disadvantages which include being limited in application, being limited in adaptability, being expensive, being nondurable, being flimsy, being heavy, being inconvenient and being difficult to use.

There is thus a need in the art for an improved plectrum.

BRIEF SUMMARY OF THE INVENTION

Discussed herein are various embodiments of devices, systems and methods for a speed pick.

In Example 1, a guitar pick comprises a generally flat, triangular body portion having first and second sides, the body portion further comprising a generally flat central thumb portion further comprising a pad.

In Example 2, the guitar pick of Example 1, wherein the body portion is substantially an acute isosceles triangle comprising a first and second equal corners and an acute corner.

In Example 3, the guitar pick of Example 2, wherein the body portion further comprises a plurality of grooves in at least one of the first and second sides.

In Example 4, the guitar pick of Example 2, wherein the body portion further comprises a plurality of inlets.

In Example 5, the guitar pick of Example 3, further comprising an opening disposed near the acute corner.

In Example 6, the guitar pick of Example 4, further comprising an opening disposed near the acute corner.

In Example 7, guitar pick comprising a generally flat, triangular body portion having first and second sides, a plurality of edges and an acute corner, at least one central contoured portion and at least one groove radiating from the contoured portion to the edge of the body.

In Example 8, the guitar pick of Example 7, further comprising a pad.

In Example 9, the guitar pick of Example 8, wherein the pad is substantially circular.

In Example 10, the guitar pick of Example 7, further comprising an opening disposed near the acute corner.

In Example 11, the guitar pick of Example 7, further comprising a surface texture.

In Example 12, the guitar pick of Example 11, wherein the surface texture is located near the acute corner.

In Example 13, a method of playing a stringed instrument, comprising providing a guitar pick comprising a flat acute isosceles triangle-shaped body comprising, edge portions, first and second sides, rounded corners, a pad and at least one a plurality of grooves or a plurality of inlets; and playing a stringed instrument with the guitar pick.

In Example 14, the method of Example 13, wherein the guitar pick further comprises providing an opening.

While multiple embodiments are disclosed, still other embodiments of the disclosure will become apparent to those skilled in the art from the following detailed description, which shows and describes illustrative embodiments of the speed pick. As will be realized, the speed pick is capable of modifications in various obvious aspects, all without departing from the spirit and scope of the disclosure. Accordingly, the drawings and detailed description are to be regarded as illustrative in nature and not restrictive.

DETAILED DESCRIPTION

Figure 1A:
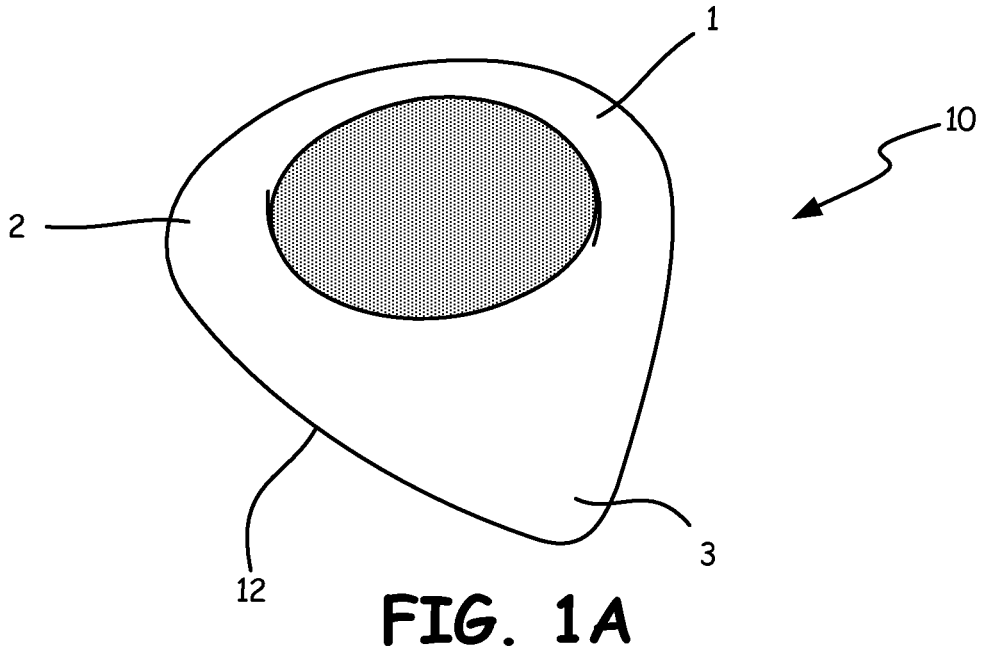
FIG. 1A depicts a perspective view of the speed pick, according to one exemplary embodiment.

As discussed herein, it is a principle object of the disclosed apparatus, system and methods (collectively the "speed pick") to provide an improved plectrum for the playing of a stringed instrument so as to improve sound and tone as well as feel and touch. While the term "speed pick" is used throughout for brevity, in no way does this limit the disclosed embodiments to a specific modality.

As used herein, "guitar" will be used to mean any stringed instrument which can be played with a corner of a flat pick, and whose sound can be modified by using picks of different gauge, and can include acoustic and electric versions of the guitar, bass guitar, banjo, lute, mandolin and the like. "Pick" will be used to mean any form of plectrum, including a flat style guitar pick having a generally triangular shape and a plurality of corners, as well as other similar devices as would be apparent. "Corner" can include rounded, flattened (truncated), or sharp ends or edges.

As discussed elsewhere herein, the various embodiments of the speed pick can include what are known as the equilateral pick, the "shark's fin" pick, and the sharp edged pick, all of which are known in the art. These picks consist of wood, plexiglass, plastic, nylon, celluloid, acetal, ultem, lexan, acrylic, delrex, rubber, felt, tortoiseshell, metal, glass, tagua, stone, or some other such material. Further, the disclosed embodiments further comprise the method of playing a stringed instrument with such pick as well as methods of producing such picks.

When playing the guitar or other stringed instrument, the pick is typically gripped between the player's thumb and forefinger and used to strike the strings of the instrument to generate sound. Increasing the speed or tempo of the striking requires an increase in the pressure applied between the player's fingers to maintain a tight grip on the pick maintain control, so as to allow the player to produce the desired sound by way of proper pick alignment and playing stroke execution. Frequently, intense, high tempo guitar playing, for example, results in the unwanted movement or "walking" of the pick around in the user's fingers, thereby increasing errors and requiring the user to readjust the grip. The presently disclosed speed pick features several novel improvements over traditional designs which afford the user greater control and dexterity with the pick, and can create improved or varied sounds when used on the strings of the stringed instrument. In certain embodiments, the speed pick is improved so as to be less flexible and afford more grip and control for the user, so as to allow the pick to glide over the surface of the strings in a distinct manner with improved control and acoustic results, such as to glide over the strings and produce, for example, a "brighter" sound quality.

In certain exemplary embodiments, the pick features an opening and center grip, or pad, such that it is hard to drop. In certain embodiments, the pick is comprised of materials which are impervious to changes in temperature or humidy, and are designed so as to be easy to grip despite wetness from sweat or rain. In certain embodiments, the pick features two grooves which are oriented in a proximal direction, and three on each side oriented distally, which provide the user with a tactile cue as to the orientation of the pick.

Turning to the figures in detail, FIGS. 1-7 depict exemplary embodiments of the speed pick 10. In exemplary embodiments, the speed pick comprises a generally flat body portion which is generally in the form of an acute isosceles triangle having generally straight or curved side portions between the corners. In certain exemplary embodiments, the corners of the speed pick will be rounded, though this is not necessary in all implementations. Other configurations are possible, as would be apparent to one of skill in the art. As depicted in the drawings, these exemplary embodiments of the speed pick comprise various improvements over prior art picks, including the addition of pads, grooves and openings which facilitate improved play, sound, and speed. There are acoustic and dexterous advantages present in the various embodiments of the speed pick. Players using the various embodiments of the speed pick report improvements in sound, control, and dexterity related to the use of the pad and/or grooves or inlets described herein. There are certain ergonomic and other advantages which are introduced by this configuration. In certain embodiments, the speed pick allows the player to change and hold the tone to be darker, or higher in pitch. In further embodiments, the countoured tip allows the player to perform certain music faster and more accurately.

FIG. 1A depicts a perspective view of an exemplary embodiment of the speed pick 10. In exemplary embodiments, the pick 10 comprises first 10A and second (not shown) substantially flat surface portions, which taper in overall body thickness to the edges and corners, so as to create the surrounding edges, as is shown generally in FIG. 1B at 9. In these embodiments, the pick 10 comprises a generally acute isosceles triangle body 12 having two substantially equal corners 1, 2 and a third, acute corner 3, which in certain embodiments is contoured so as to allow for specific striking of the strings, in certain embodiments, the third corner or acute corner 3 is contoured into a rounded tip, as would be apparent from the drawings to one of skill in the art. In these embodiments, the third corner 3 is the corner utilized for directly striking the strings of the instrument (not shown), as would be well known in the art.

Figure 1B:
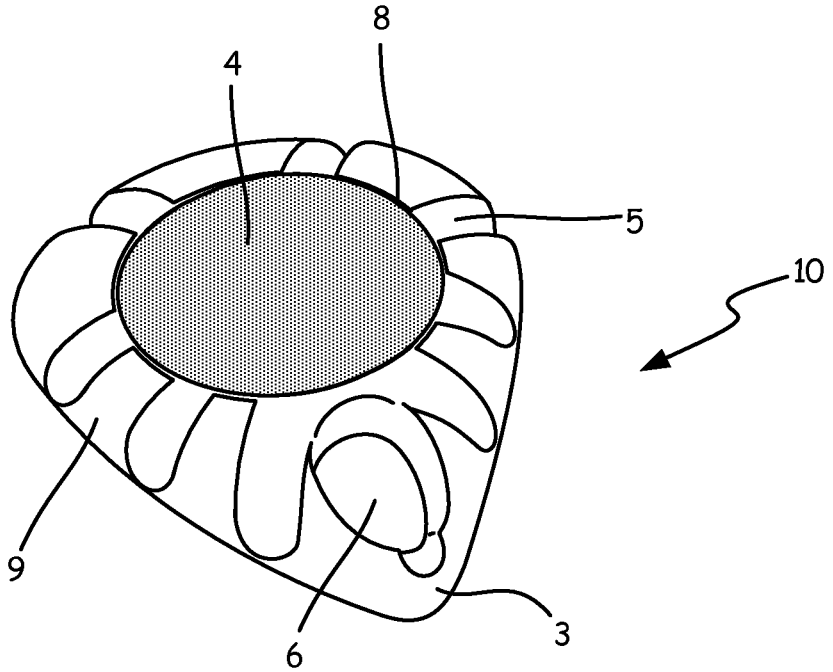
FIG. 1B depicts a perspective view of the speed pick, according to a further exemplary embodiment.

As is shown in FIG. 1A-1B, exemplary embodiments of the speed pick 10 further comprise a generally circular pad 4. The pad 4 is structurally integrated onto or into the body 12 of the pick 10 and can be comprise a sandpaper-like texture, or other established means of increasing the friction between the player's finger and the pick itself, such as rubber or other synthetics.

As shown in FIG. 1B, certain embodiments further comprise a plurality of notches or grooves 5, which generally radiate from the central pad region out to the edges of the side portions, or edges, so as to be capable of being in contact with the portions of the user's thumb and/or other fingers during use. These grooves can be arranged in a variety of patterns, both for aesthetic and performance reasons; and may be generally round or rectangular in the various embodiments.

In certain embodiments, the pad assists the player by eliminating or reducing humidity or moisture and improving the player's grip on the pick. In certain embodiments, the pad is placed on opposite sides of the speed pick, in others the pad may only be present on one of the two flatted sides. In certain embodiments, the triangular body 12 features certain concaves or contours 8 in the center of either flat side so as to further accommodate the mounting of the pad 4, as would be apparent to one of skill in the art.

In yet additional embodiments, an opening 6 may be introduced into the third corner 3, wherein this opening provides additional acoustic or dexterous advantages to the player. Embodiments featuring the grooves 5 and/or opening 6 provide certain advantages to certain players seeking to increase the speed of the strumming, such as "shredders." Further, these grooves can provide certain advantages for those seeking to "airplane." There is improved feel and control of the pick, which allows the user to have greater sensation relating to the exact location and orientation of the pick. Further embodiments feature the notches or grooves but do not feature the pad 4.

Figure 2:
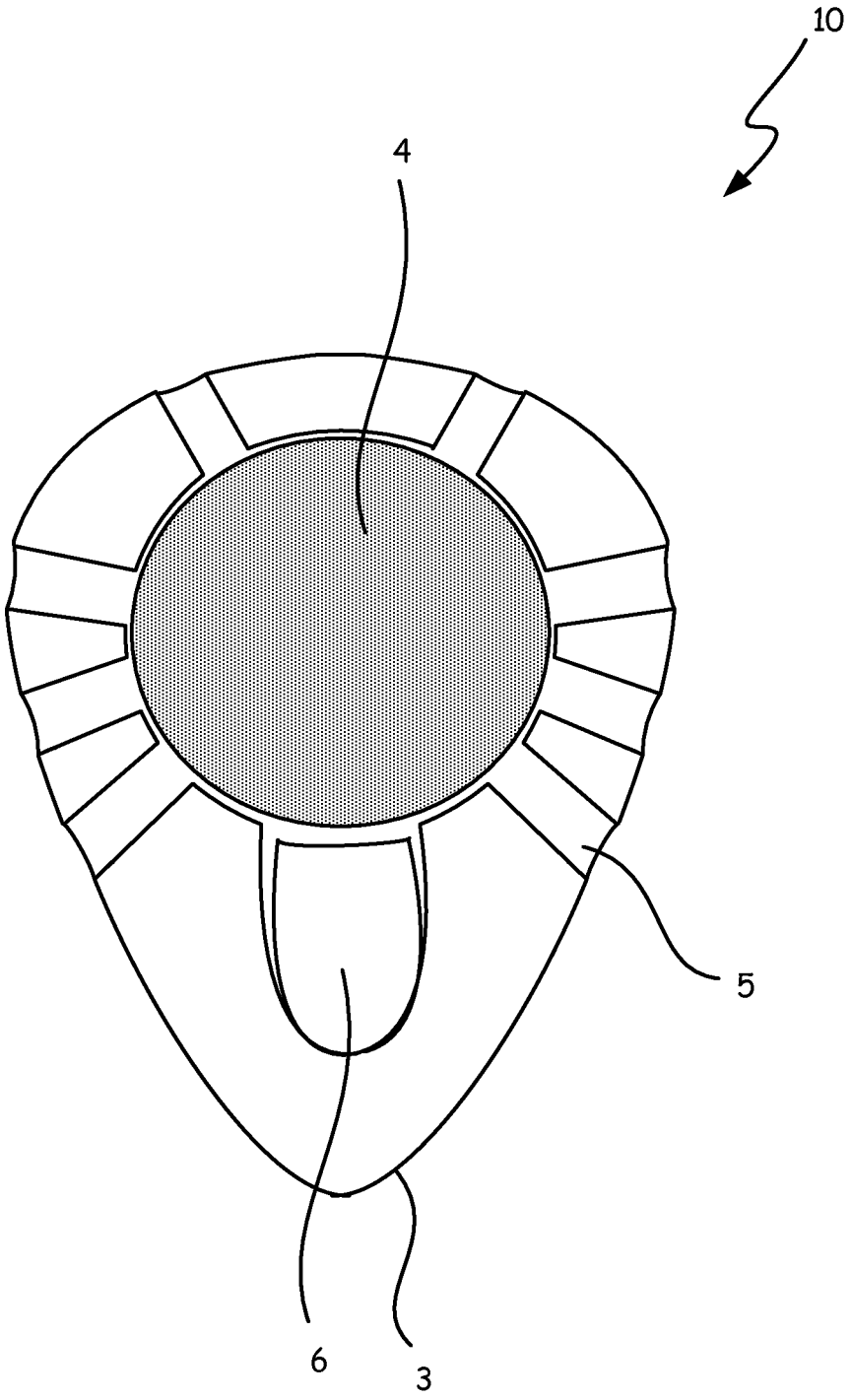
FIG. 2 depicts a top view of the speed pick, according to a further exemplary embodiment.

FIG. 2 depicts a top view of another exemplary embodiment of the speed pick 10 featuring grooves 5 and an opening 6 near the third corner 3.

Figure 3:
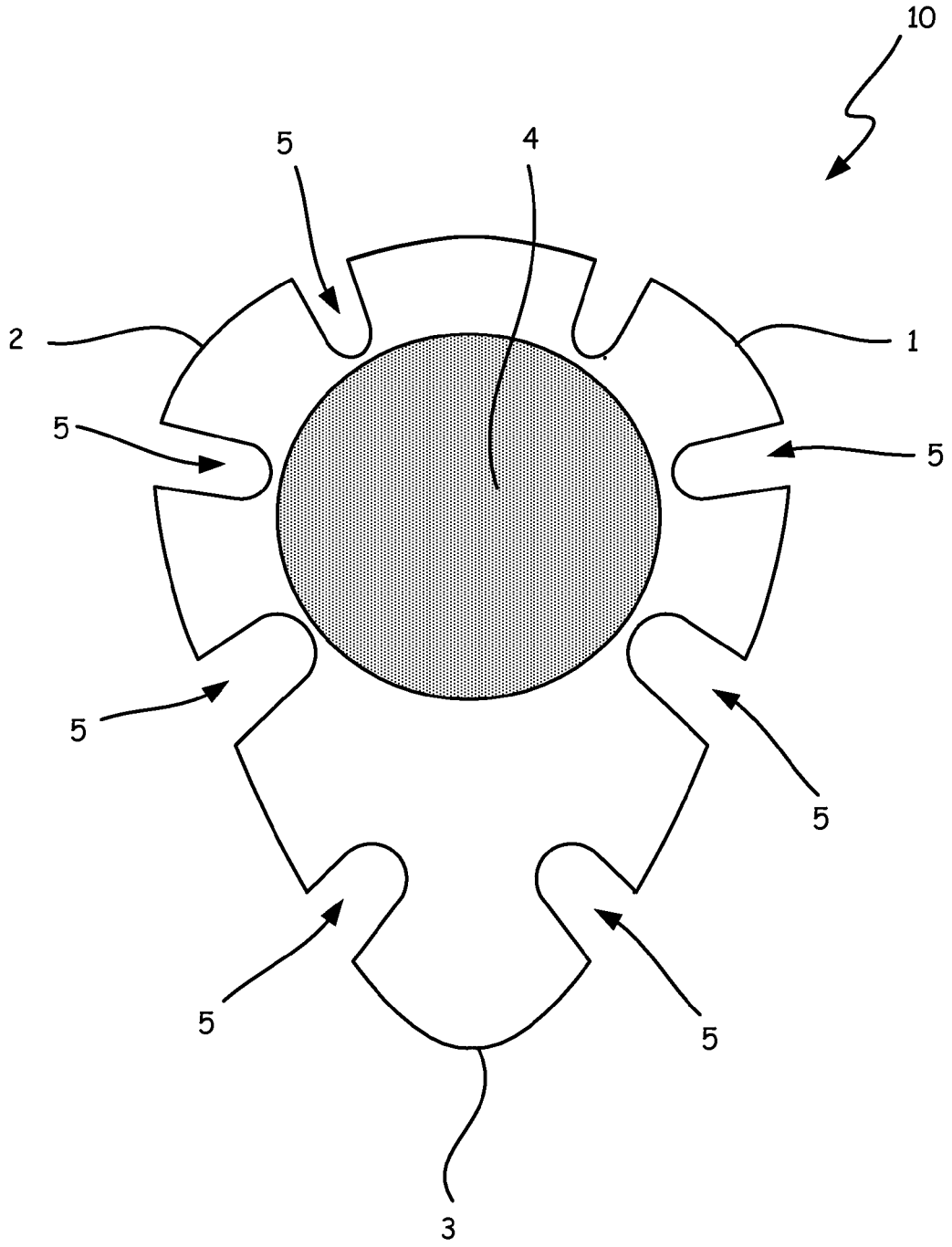
FIG. 3 depicts a top view of the speed pick, according to yet another exemplary embodiment.

As shown in FIG. 3, in certain embodiments the grooves may pass completely through the body 12 of the pick 10 from the first side to the second side, so as to create radial openings, or inlets 7 around the first 1 and second 2 corners, such that they pass through from the first to second substantially flat surface portions. In certain embodiments, these grooves can give the user further benefits in terms of dexterity and the ability to strike or otherwise manipulate the strings of the stringed instrument. In further embodiments, the pad 4 may further comprise a logo or other aesthetic feature.

Figure 4A:
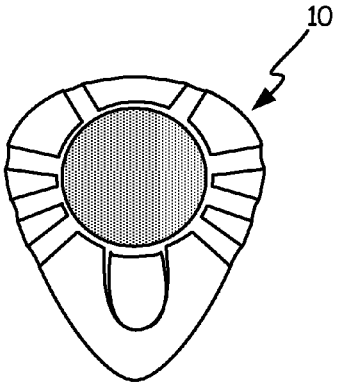
FIG. 4A depicts a top view of an alternative embodiment of the speed pick, comprising at least one proximal groove 5A, and at least one distal groove 5B.
Figure 4B:
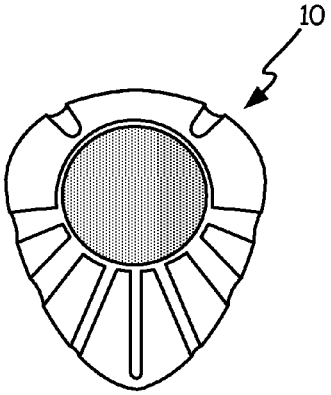
FIG. 4B depicts a top view of a further alternative embodiment of the speed pick wherein the grooves are rounded.

FIG. 4A depicts a top view of an alternative embodiment of the speed pick, comprising at least one proximal groove 5A, and at least one distal groove 5B. FIG. 4B depicts a top view of a further alternative embodiment of the speed pick wherein the grooves are rounded, and the proximal groove 5A or grooves are disposed at a greater radial distance distance from the distal groove 5B or grooves, as opposed to the embodiment of FIG. 4A, as would be apparent to one of skill in the art.

Figure 4C:
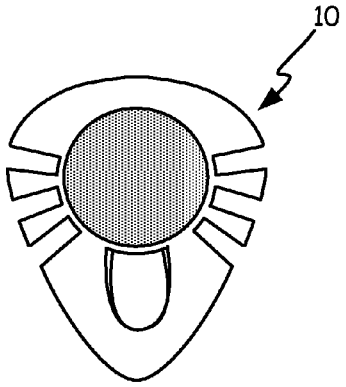
FIG. 4C depicts a top view of a further alternative embodiment of the speed pick featuring a plurality of side inlets.
Figure 4D:
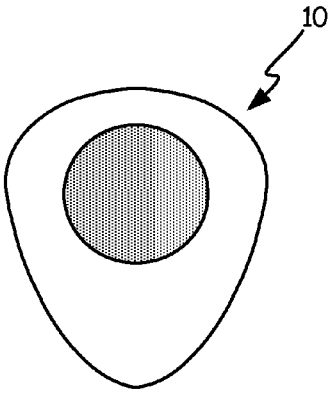
FIG. 4D depicts a top view of a further alternative embodiment of the speed pick with a pad.

FIG. 4C depicts an embodiment featuring a plurality of side inlets 7A. FIG. 4D depicts an embodiment of the pick 10 comprising only the pad 4.

Figure 4E:
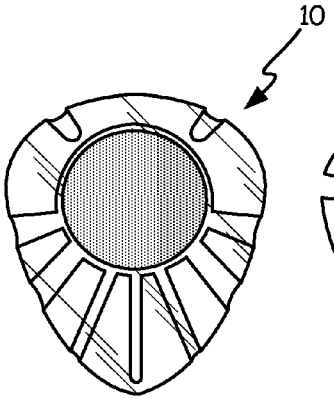
FIG. 4E depicts a top view of a further alternative embodiment of the speed pick with texture.

In the embodiment of FIG. 4E, the pick 10 further comprises further body texture 12A, such as hatching or roughness. In these embodiments, the first and/or second sides of the pick 10 are not smooth, but rather hatched, cross-hatched, scored, or otherwise treated or formed so as to give them a texture for increased grip and control.

Figure 4F:
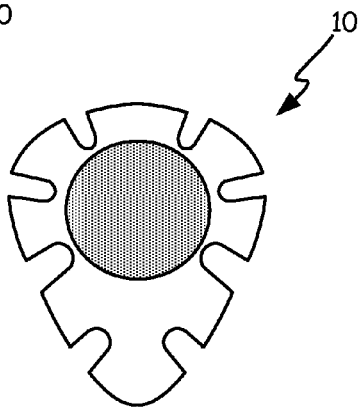
FIG. 4F depicts a top view of a further alternative embodiment of the speed pick having an alternative configuration of radial inlets.

FIG. 4F depicts an embodiment of the speed pick 10 comprising an alternative configuration of radial inlets 7B. Other configurations are possible, as would be apparent to one of skill in the art.

Figure 5:
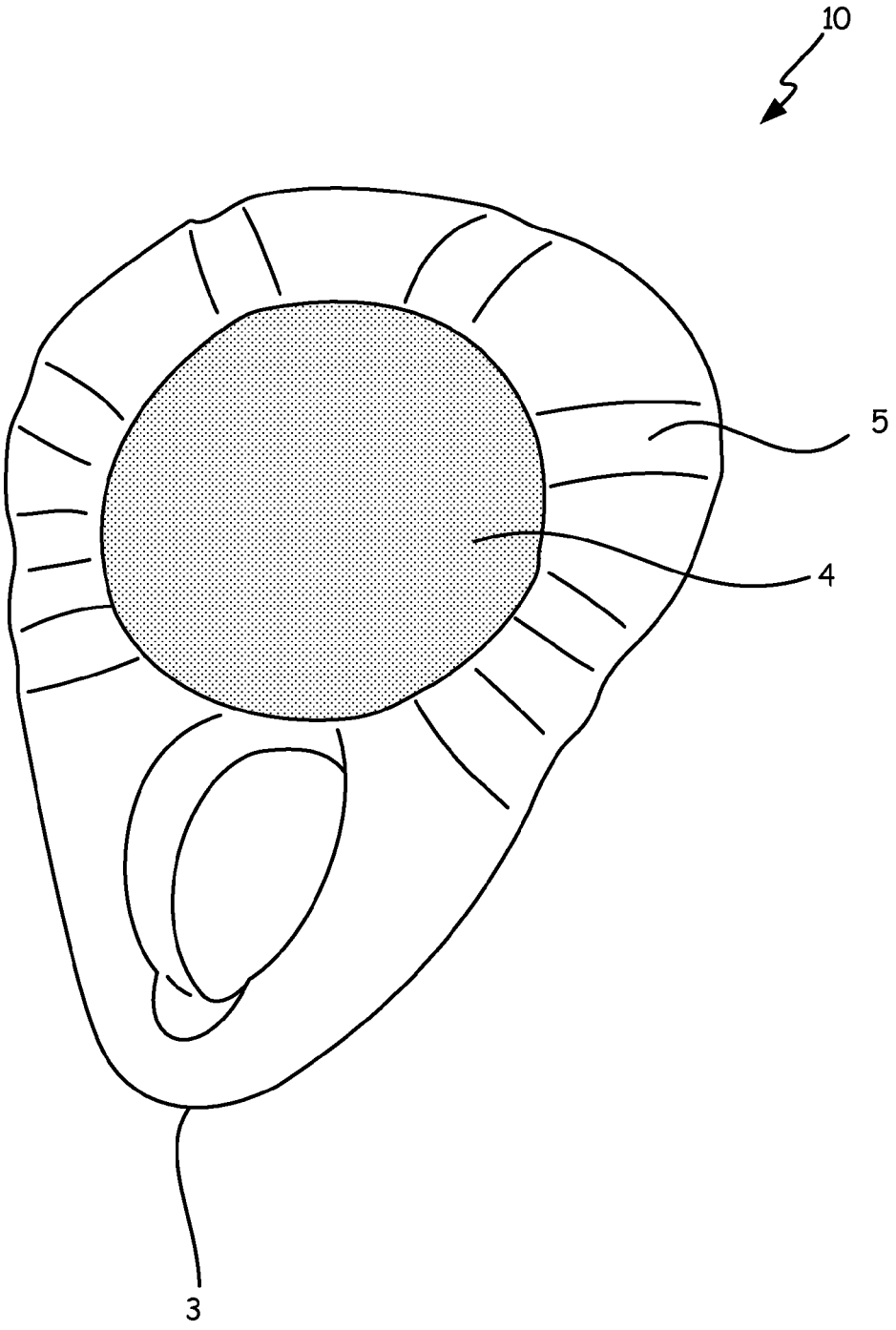
FIG. 5 depicts a perspective view of an alternative embodiment of the speed pick further comprising a plurality of contoured grooves.

FIG. 5 depicts an embodiment of the speed pick further comprising a plurality of contoured grooves 5C, such that the texturing is relatively subtle, but still discernible to the user. In these embodiments, the speed pick may further comprise the pad 4 and/or opening 6.

Figure 6:
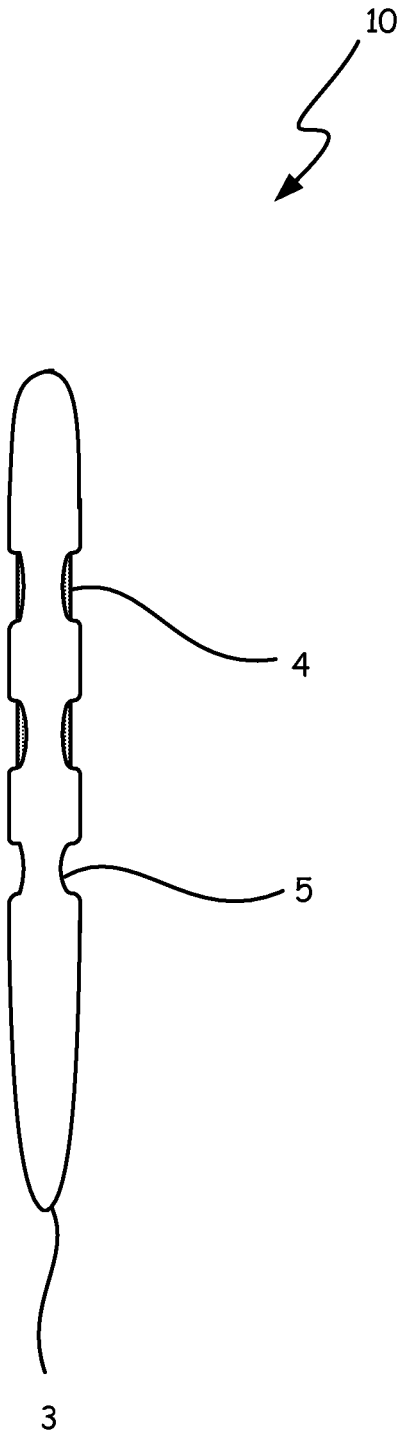
FIG. 6 depicts a side view of an exemplary embodiment of the pick showing the pad and grooves.

FIG. 6 depicts a side view of an exemplary embodiment of the pick 10 comprising the pad 4 and grooves 5.

Figure 7:
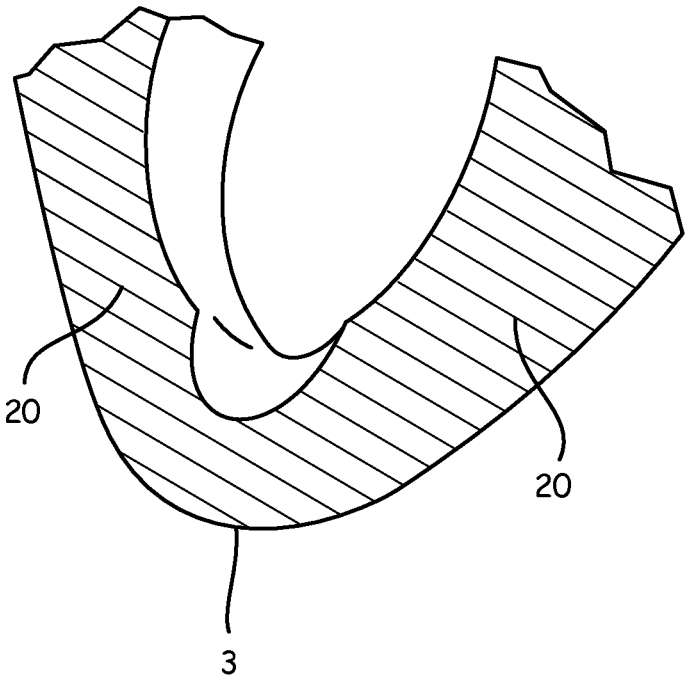
FIG. 7 depicts a perspective view of the acute corner of an alternative embodiment of the speed pick having tip texture.

FIG. 7 depicts a perspective view of the an alternative embodiment of the speed pick 10 wherein the acute corner 3 further comprises cross-hatching and further texture so as to enhance the acoustics and/or feel of the pick.

In various embodiments, the speed pick can be molded out of one or more plastics, such as plexiglass, acylic, celluloid, delrex, nylon, ultem, acetal, lexan, and the like, whether alone or in combination, and whether extruded, layered or prepared by some other means. In further embodiments, metal can be utilized, such as aluminum, brass, steel, or solid copper so as to introduce certain harmonic advantages. In yet further embodiments, the speed pick may be hewn or carved from any type of wood, such as pine, oak, maple, cedar, and the like, or more exotic woods such as African Blackwood, Bocote, Cocobolo, Lignum vitae, Rosewood, or Zebrawood. Certain embodiments will be comprised of glass, or other clear, hard materials. Further embodiments may consist of agate, composite, carbon fiber, stone, felt, tortis, tagua, PHD, high pressure laminate, or other such materials. Thicknesses of any length between 0.4 mm-10 mm can be utilized, though in certain preferred embodiments the thickness is greater than 1.5 mm, greater than 2.5 mm, 5 mm or more. In certain embodiments, the pick may be ⅛th to ¼" thick, or more. As would be apparent to one of skill in the art, many configurations are possible, and exemplary embodiments of the speed pick may be thicker than industry standard picks, which typically range from 0.4 mm-1.5 mm, and are typically flexible. Exemplary embodiments are accordingly less flexible than industry standard picks.

In certain embodiments, the speed pick disclosed herein is larger than the industry standard pick. In certain exemplary embodiments, the pick is more rigid than the industry standard pick. In certain exemplary embodiments, plexiglass or wood is used for the body of the pick. In certain embodiments, a pad is provided, which is generally round and fixedly attached to the body of the pick. In certain embodiments, the pad is set into a recess on the surface of the pick. In certain embodiments, the body of the pick is otherwise contoured.

Although the disclosure has been described with reference to preferred embodiments, persons skilled in the art will recognize that changes may be made in form and detail without departing from the spirit and scope of the invention.

What is claimed is:

1. A guitar pick, comprising:

a generally flat, triangular body portion having first and second sides, the body portion further comprising a generally flat central thumb portion further comprising a pad, said pad being circular having a peripheral edge inwardly spaced from outer edges of said first and second sides; and a plurality of grooves in at least one of the first and second sides, each of said grooves extending radially outward from said pad and towards said outer edges of said first and second sides.

2. The guitar pick of claim 1, wherein the body portion is substantially an acute isosceles triangle comprising a first and second equal corners and an acute corner.

3. The guitar pick of claim 1, further comprising a plurality of inlets in at least one of said first and second sides, each of said inlets extending radially relative to said pad, each of said inlets extending partially between said pad and said outer edges of said first and second sides.

4. The guitar pick of claim 1, further comprising an opening disposed near the acute corner.

5. The guitar pick of claim 1, wherein the pad is circular.

6. A guitar pick comprising:

a generally flat, triangular body portion having first and second sides, a plurality of edges and an acute corner;

at least one central contoured portion;

a pad, said pad being circular and coupled to said body portion occupying said central contoured portion; and at least one groove radiating from the contoured portion to the edge of the body.

7. The guitar pick of claim 6, further comprising an opening disposed near the acute corner.

8. The guitar pick of claim 6, further comprising a surface texture on said pad wherein said pad is configured for enhancing friction when gripping said body portion by contact with said pad.

* * * * *